US005162699A

United States Patent [19]

Tokoro et al.

[11] Patent Number: 5,162,699

[45] Date of Patent: Nov. 10, 1992

[54] ION SOURCE

[75] Inventors: Nobuhiro Tokoro, West Newbury; Richard C. Becker, Ipswich, both of Mass.

[73] Assignee: Genus, Inc., Mountain View, Calif.

[21] Appl. No.: 776,598

[22] Filed: Oct. 11, 1991

[51] Int. Cl.[5] ..... H01J 27/02

[52] U.S. Cl. ..... 315/111.81; 315/111.41; 313/359.1; 250/423 R

[58] Field of Search ..... 315/111.21, 111.31, 315/111.41, 111.81; 313/359.1, 231.31; 250/423 R, 427

[56] References Cited

U.S. PATENT DOCUMENTS 3,798,488 3/1974 Pleshivtsev et al. ..... 313/231.81
3,960,605 6/1976 Beck et al. ..... 357/91 X
4,297,615 10/1981 Goebel et al. ..... 315/111.21
4,377,773 3/1983 Hershcovitch et al. ..... 315/111.81
4,754,200 6/1988 Plumb et al. ..... 315/111.81
4,760,262 7/1988 Sampayan et al. ..... 315/111.81 X
4,774,437 9/1988 Helmer et al. ..... 315/111.81
4,792,687 12/1988 Mobley ..... 250/423 R
4,885,070 12/1989 Campbell et al. ..... 204/298.04 X
4,891,525 1/1990 Firisa et al. ..... 315/111.81 X
4,980,556 12/1990 O'Connor et al. ..... 250/423 R
4,994,706 2/1991 Leung et al. ..... 313/231.01 X
5,089,746 2/1992 Rosenblum et al. ..... 315/111.81

*Primary Examiner*—Eugene R. LaRoche
*Assistant Examiner*—Do Hyun Yoo
*Attorney, Agent, or Firm*—Nields and Lemack

[57] ABSTRACT

An ion source of high ion yield, especially boron yield, is provided with a boron compound of high melting point and low work function such as $LaB_6$ (lanthanum hexaboride) at a suitable location inside the arc chamber of the ion source, which operates on the principle of ion production by using a hot cathode to produce hot electrons.

7 Claims, 3 Drawing Sheets

ION SOURCE

BACKGROUND OF THE INVENTION

1. Field of the Invention

This invention relates to ion sources.

An ion source is an apparatus which produces ions in ion accelerating apparatus which uses these ions. Such an ion source ionizes atoms of a material necessary for some specific purpose, and the ion accelerating apparatus accelerates the ions using an electric field, etc.

One type of ion accelerating apparatus used in industry is ion implanting apparatus which is used to manufacture semiconductor devices. In such apparatus, in order to form P-N junctions on silicon wafers, one makes use of the production of various ions by means of an ion source, such as boron (B), phosphorus (P), arsenic (As), or antimony (Sb). Such ions are accelerated by any of a number of various ion accelerators, such as single-stage accelerators, tandem accelerators, rf linear accelerators, etc.

Among the aforementioned ions, only boron can be used as a P type dopant.

2. Description of the Prior Art

In order to produce these boron ions, since boron itself has a very high melting point of 2300° C., it is difficult to produce the vapor, and in the past mainly $BF_3$ (on rare occasions $BCl_3$) have been used as the material for supplying the ion source. However, when these molecular-condition materials are supplied to the ion source, various types of ions such as $F^+$, $BF^+$, $BF_2^+$, etc. are formed in addition to the desired $B^+$, and the defect occurs that the yield of the desired ion is adversely affected. Moreover, in order to increase the yield of $B^+$ (viz. the rate of decomposition of molecules of $BF_3$, etc.), one raises the temperature of the plasma, and it becomes necessary to use a greater scale filament electric power supply, anode electric power supply, cooling system, etc. Thus the defect occurs that the apparatus becomes large scale and high price. Moreover, electric discharges, etc. occur frequently because of higher power consumption, and thus the defect occurs that the operation of the ion source becomes unstable.

SUMMARY OF THE INVENTION

This invention aims at the removal of these problems, and has as its object the furnishing of an ion source of high ion yield, especially boron yield. This invention attains the foregoing object by providing suitable material such as $LaB_6$ (lanthanum hexaboride) at a suitable location inside the arc chamber of the ion source, which operates on the principle of ion production by using a hot cathode to produce hot electrons.

BRIEF DESCRIPTION OF THE DRAWINGS

The invention may best be understood from the following detailed description thereof, having reference to the accompanying drawings, in which.

DESCRIPTION OF THE PREFERRED EMBODIMENT

Figure 1:
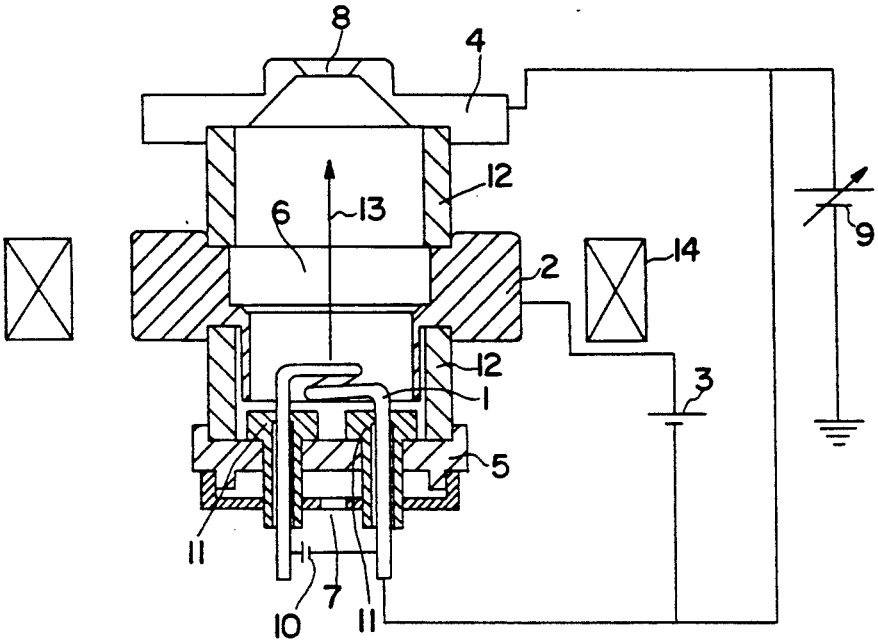
FIG. 1 PRIOR ART
FIG. 1 is a view in central section of a hot-cathode PIG ion source constructed in accordance with the prior art.

FIG. 1 shows the construction of a hot-cathode PIG ion source (i.e. an ion source having so-called Penning ionization gauge geometry), which is one type of prior-art hot-cathode-type ion source which is used in ion-implanting equipment for manufacturing semiconductors. One suitable PIG ion source is that manufactured by Genus, Inc. under the designation Model G1500. Further details regarding PIG ion sources are set forth in U.S. Pat. No. 4,980,556 to O'Connor and White and U.S. Pat. No. 2,197,079 to Penning.

By passing electric current through a filament 1 it is heated and hot (thermal) electrons are emitted. An annular anode 2 is maintained at a positive potential of normally 50–150 V with respect to the filament 1 by means of an anode power supply 3. The electrons which are emitted from the filament 1 are accelerated towards the anode 2 and finally reach the anode 2. However, owing to an external magnetic field 13 which is produced in the direction along the axis of the annular anode 2 by suitable means such as a solenoid coil 14, these electrons execute cyclotron motion and are confined in the space between an ion extraction electrode 2 and a base 5. Meanwhile, the emitted electrons collide with a substance which has been introduced into arc chamber 6 through ionizable material introduction aperture 7, and a plasma is formed within the arc chamber 6. Positive ions including the desired ions are extracted in the form of a beam from the ion source extraction aperture 8 by means of a positive extraction voltage applied to the ion extraction electrode 4 by an extraction power supply 9. Thereafter the positive ions are accelerated, mass-analyzed, and transported to a certain target to be used for various purposes.

The electric current for the filament 1 is supplied by a filament power supply 10. The filament 1 is supported within a filament insulator 11 mounted within the base 5. The anode 2 is supported by anode insulators 12 extending from the anode 2 to the ion extraction electrode 4 and the base 5 so as to contribute to the formation of the arc chamber 6.

The construction of the present invention will now be explained in detail, based upon the examples shown in FIGS. 2 and 3.

Except for the $LaB_6$ parts shown at 21 and 22, the essential nature of the construction is the same as the prior art as shown in FIG. 1, and the explanation will be abbreviated by using the same reference numerals. In the embodiment of FIG. 2 ring-shaped $LaB_6$ 21 is placed in a pocket which is formed in the filament insulator 11. This $LaB_6$ 21 is constructed so as barely to maintain contact with the filament 1, and the head part is positioned so as to protrude into the inside of arc chamber 6.

When the ion source is activated, the filament 1 reaches a high temperature of ordinarily 2000° C. or above. The aforesaid $LaB_6$ 21 is electrically and thermally in contact with this high-temperature filament, and so this $LaB_6$ 21 itself is heated, emits thermal electrons, and performs the role of a filament. At this time, at the same time, the materials from which it is constructed (in the present example La and B) are thermally evaporated and are drawn directly into the arc chamber 6. Consequently, one can rapidly increase the yield of boron ions.

Figure 4:
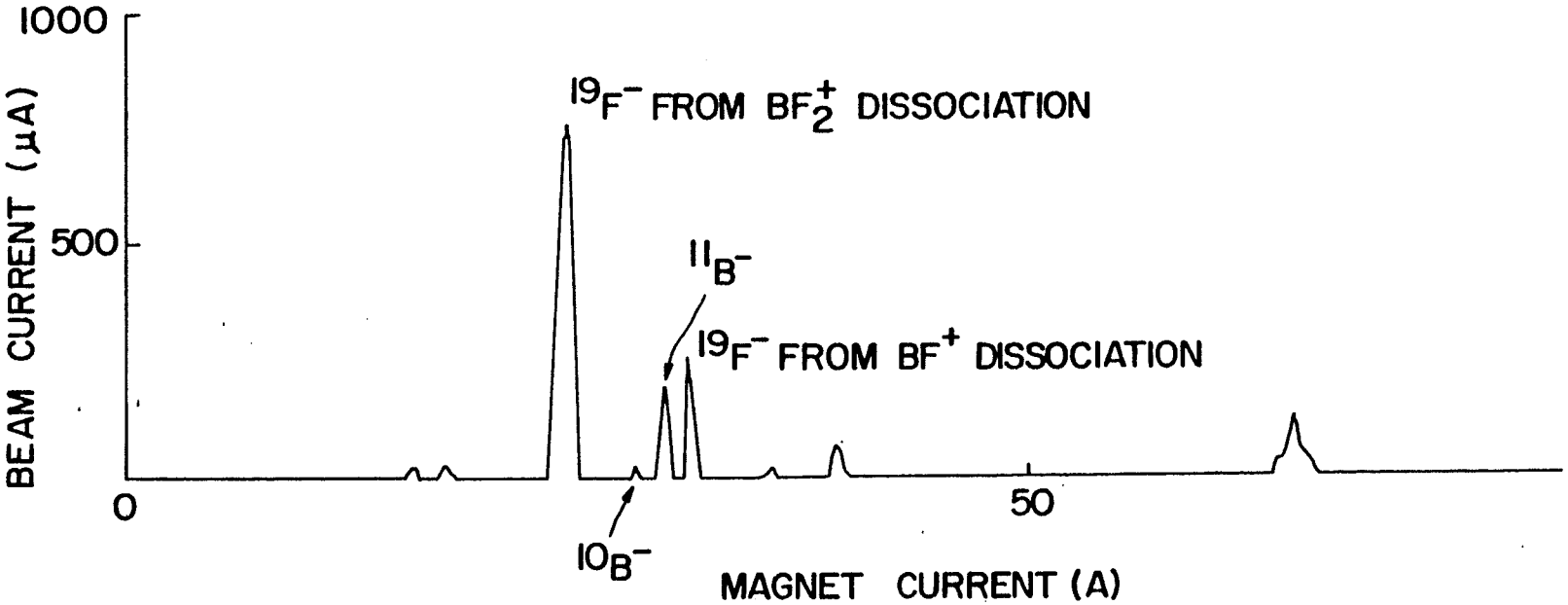
FIG. 4 is a mass spectrum showing data obtained with the apparatus of FIG. 1.
Figure 5:
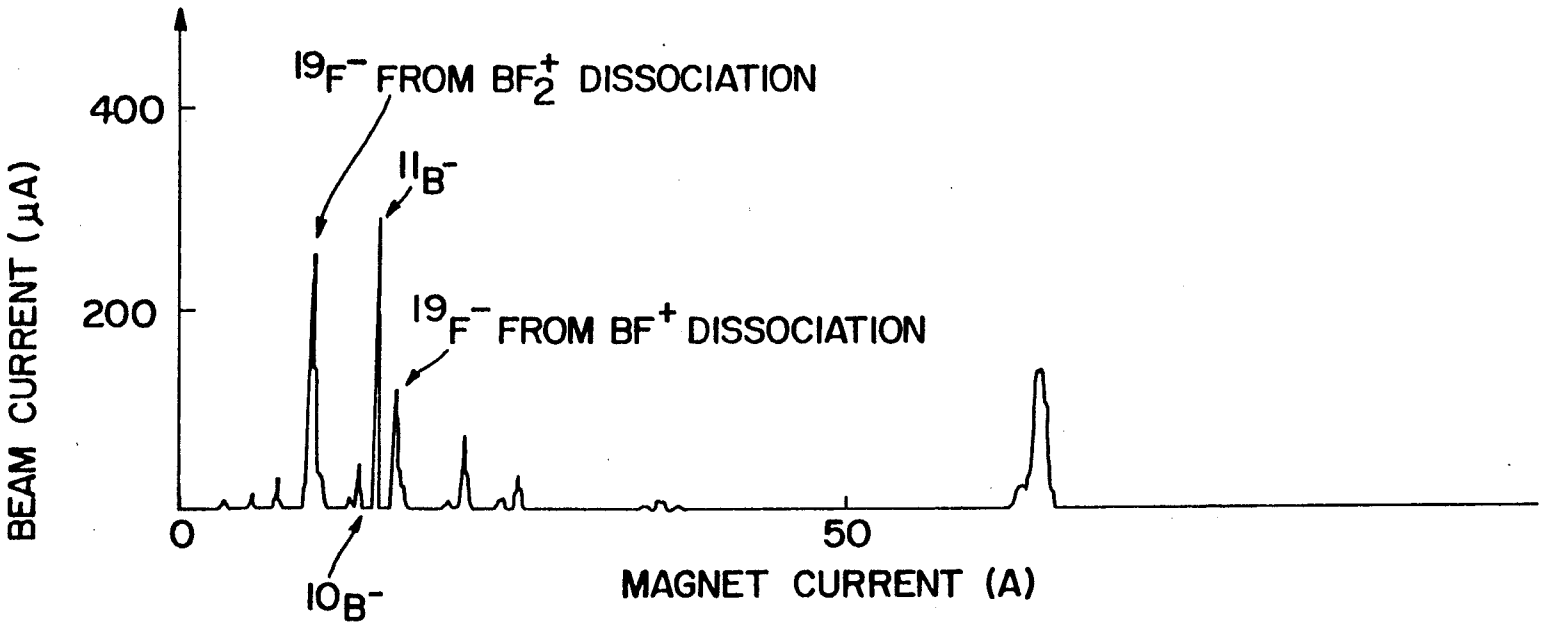
FIG. 5 is a mass spectrum showing data obtained with the apparatus of FIG. 2.

The principles of the instant invention can be proved by comparing FIG. 4 and FIG. 5.

FIG. 4 is a mass spectrum when producing boron ($^{11}B$) using $BF_3$ and the prior-art ion source of FIG. 1. Herein $^{11}B$ enriched material was used as the $BF_3$ gas. Consequently, the isotope ratio of $^{10}B$ to $^{11}B$ was about 10%:90%. (The natural ratio is about 20%:80%). Moreover, herein the extracted ions are passed through magnesium vapor in a manner similar to that disclosed in the aforementioned U.S. Pat. No. 4,980,556, and so it is the resulting negative-ion component which is analyzed. As stated hereinabove, inside the ion source ions such as $BF^+$, $BF_2^+$ are produced, and so when these molecular ions are passed through magnesium vapor two striking peaks of $F^-$ from $BF_2^+$ and $BF^+$ molecular dissociation can be separated out, and the yield of these $F^+$ peaks is proportional to the amount of $BF^+$ which is produced inside the arc chamber. The beam current of $^{11}B^-$ which is obtained is about 200 $\mu$ A in the case where the voltage of the ion source extraction is 40 kV and the extraction current is about 25 mA.

Figure 2:
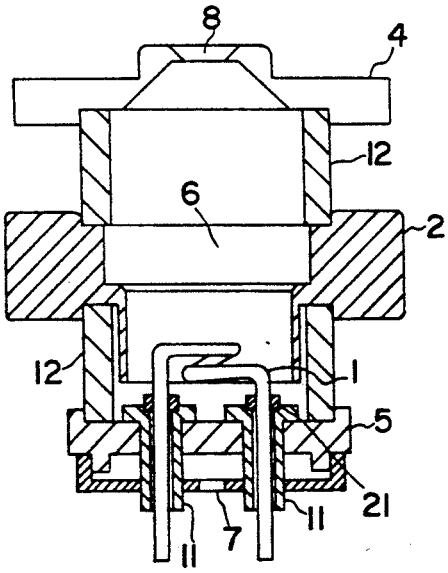
FIG. 2 is a view similar to that of FIG. 1 and showing one construction in accordance with the instant invention.

FIG. 5 is a mass spectrum when activating the ion source under conditions identical to those involved in the mass spectrum of FIG. 4, but using the example of the instant invention shown in FIG. 2. In this case, the isotope ratio of $^{10}B$ to $^{11}B$ was 15%:85%, and the boron ($^{10}B$ and $^{11}B$) from the furnished $LaB_6$ is seen to have been drawn into the middle of the plasma. (This is because the boron included in $LaB_6$ has the natural isotope ratio.) Moreover, the amount of $F^-$ which is produced by dissociation from the molecular ions $BF^+$, $BF_2^+$ is remarkably reduced, and because of the increase in the quantity of electrons released in the arc chamber 6 of the ion source it is seen that the frequency of collisions of electrons is increased, so that molecular ions within the plasma are reduced. From the above results one can recognize that the amount of beam current of the $^{11}B^-$ produced is 300 $\mu$ A or more, and results in a beam current increase of 50% or more.

Figure 3:
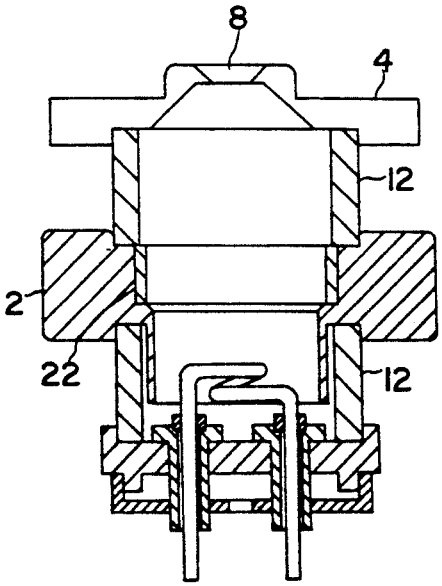
FIG. 3 is a view similar to that of FIG. 2 and showing another construction in accordance with the instant invention.

In the embodiment of the instant invention shown in FIG. 3, a ring of $LaB_6$ 22 is also provided on the inside of the anode 2. This promotes the supply of this material into the plasma and further heightens the increase in beam current. Preferably the boron compound such as $LaB_6$ is provided at a location sufficiently close to the hot cathode for adequate heating of said boron compound.

The instant invention is not limited to the use of lanthanum hexaboride to increase the yield of boron ions, but includes the use of any boron compound having a high melting point and a low work function. Preferred boron compounds include, in addition to lanthanum hexaboride, $BaB_6$, $CaB_6$, $CeB_6$, $SrB_6$ and $ThB_6$. Moreover, it is possible to extend the construction of the instant invention to other high melting point materials such as C, Mo, Ti, etc. Lanthanum hexaboride is the most preferred boron compound, because at a temperature of about 2000° C. it not only emits electrons copiously by thermal emission, but also provides a copious supply of boron atoms by evaporation. The melting point of lanthanum hexaboride is 2210° C. and the work function of lanthanum hexaboride is about 2.7 eV, as compared with 4.54 eV for tungsten.

The instant invention has the foregoing construction and operation, and by providing a substance such as $LaB_6$ at appropriate places inside the arc chamber of the ion source, there results a remarkably heightened ion yield, especially boron ion yield, without using any supplementary electric power supply, etc. and without any enlargement of the system.

Having thus disclosed the principles of the invention, together with several illustrative embodiments thereof, it is to be understood that, although specific terms are employed, they are used in a generic and descriptive sense, and not for purposes of limitation, the scope of the invention being set forth in the following claims.

We claim:

1. Ion source of the type which uses a hot cathode to produce hot electrons which in turn produce ions, comprising in combination a chamber containing an ionizable gas having boron therein, a filament, means for passing electric current through said filament, whereby said filament is heated to a temperature sufficiently high to cause thermal emission of electrons, an anode, means for producing an electric field between said filament and said anode which is adapted to accelerate electrons from said filament toward said anode, means for producing a magnetic field in the region between said filament and said anode which is adapted to lengthen the path followed by said electrons in traveling toward said anode whereby a plasma is produced in said chamber as a result of ionization of said gas by said electrons, means for extracting positive ions having boron therein from said chamber, and a suitable quantity of material comprising a boron compound having high melting point and low work function mounted at a suitable location inside said chamber to cause the evaporation of boron from said boron compound by heating said filament, whereby the ion yield and especially the boron ion yield are increased.

2. Ion source according to claim 1, wherein said boron compound is in electric and thermal contact with said filament.

3. Ion source according to claim 2, wherein said boron compound is selected from the group consisting of $LaB_6$, $BaB_6$, $CaB_6$, $CeB_6$, $SrB_6$ and $ThB_6$.

4. Ion source according to claim 3, wherein said boron compound is lanthanum hexaboride.

5. Ion source according to claim 1, wherein said boron compound is mounted on said anode close to the filament for adequate heating of said boron compound.

6. In an ion source for producing boron ions comprising a filament, an ion extraction electrode, an anode and a base mounted to form an arc chamber, said base having filament insulators mounted therein, said filament extending through said filament insulators, the improvement comprising the provision of lanthanum hexaboride members in thermal and electric contact with said filament, the operating temperature of said filament being sufficiently high to cause the evaporation of boron for formation of positive boron ions and the thermal emission of electrons from said lanthanum hexaboride members in amounts sufficient to enhance boron ion beam current extracted from said arc chamber.

7. Ion source of the type which uses a hot cathode to produce hot electrons which in turn produce ions, comprising in combination a chamber containing an ionizable gas having boron therein, a filament, a suitable quantity of material comprising a boron compound having high melting point and low work function mounted at a suitable location inside said chamber in the vicinity of said filament, means for passing electric current through said filament, whereby said filament is heated to a temperature sufficiently high to cause thermal emission of electrons and to cause the evaporation of boron from said boron compound, an anode, means for producing an electric field between said filament and said anode which is adapted to accelerate electrons from said filament toward said anode, means for producing a magnetic field in the region between said filament and said anode which is adapted to lengthen the path followed by said electrons in traveling toward said anode whereby a plasma is produced in said chamber as a result of ionization of said gas by said electrons, means for extracting positive ions having boron therein from said chamber, whereby the ion yield and especially the boron ion yield are increased.

* * * * *